US005356518A

United States Patent [19]

Kelley et al.

[11] Patent Number: 5,356,518

[45] Date of Patent: Oct. 18, 1994

[54] METHOD OF PRODUCING MOLDED PAPER PULP ARTICLES AND ARTICLES PRODUCED THEREBY

[75] Inventors: Joseph Kelley, Hamilton County; James Parks, Warren County, both of Ohio; Robert Frey, Kenton County, Ky.; Richard Reames, Allegan County; William Forester, Kalamazoo County, both of Mich.

[73] Assignee: The Cin-Made Corporation, Cincinnati, Ohio

[21] Appl. No.: 948,010

[22] Filed: Sep. 21, 1992

[51] Int. Cl.[5] ..... D21J 1/04

[52] U.S. Cl. ..... 162/224; 162/416; 162/223

[58] Field of Search ..... 162/224, 228, 230, 415, 162/416, 223, 401–406, 396; 264/87, 86

[56] References Cited

U.S. PATENT DOCUMENTS

| | | | |
|---|---|---|---|
| 1,936,134 | 6/1934 | Keiding | 162/220 |
| 2,006,831 | 7/1935 | Hawley | 162/415 |
| 2,321,574 | 6/1943 | Chaplin | 162/415 |
| 2,752,830 | 7/1956 | Randall et al. | 162/415 |
| 2,996,118 | 8/1961 | Chaplin | 162/416 |
| 3,813,284 | 5/1974 | Yasuhiro et al. | 162/416 |
| 3,905,740 | 9/1975 | Lovejoy | 425/577 |
| 4,201,535 | 5/1980 | Ninneman | 425/577 |

FOREIGN PATENT DOCUMENTS

| | | | |
|---|---|---|---|
| 548756 | 10/1942 | United Kingdom | 162/228 |

*Primary Examiner*—W. Gary Jones
*Assistant Examiner*—Brenda Lamb
*Attorney, Agent, or Firm*—Flynn, Thiel, Boutell & Tanis

[57] ABSTRACT

A method of manufacturing a molded paper pulp article from a fiber slurry involves the vacuum deposition of a layer of wet paper pulp onto a forming mold, the separation of the wet layer of paper pulp from the forming mold and the pressing and shaping of the layer of wet paper pulp at a solids content of from about 5 to 20 percent solids. A finished product molded paper article is prepared having improved surface appearance and detailing and improved mechanical and physical properties.

11 Claims, 5 Drawing Sheets

METHOD OF PRODUCING MOLDED PAPER PULP ARTICLES AND ARTICLES PRODUCED THEREBY

FIELD OF THE INVENTION

This invention relates to a method of manufacturing molded paper pulp articles and, more particularly, to a method of manufacturing molded paper pulp articles having improved strength, surface characteristics and greater physical properties.

BACKGROUND OF THE INVENTION

With the general public becoming more environmentally aware and the cost of energy sources increasing, recycling of various products has been steadily gaining favor with various industries. Certain products, such as glass and plastic containers, lend themselves to recycling because of their ability to maintain their physical integrity and their mechanical properties during their use. However, the initial cost of manufacturing these types of containers is high due to the cost of the raw materials and the complicated manufacturing processes necessary for forming them.

Vast quantities of paper products are consumed daily in modern society. However, due to the perishability of these paper products and the limited use that can be made of these paper products upon reclamation, extensive utilization of reclaimed paper products has not yet been realized. Although various processes are currently available for utilizing recycled paper in the form of pulp, molded products produced by these processes are limited in the complexity of their form and structure and do not offer satisfactory surface characteristics and physical properties.

U.S. Pat. No. 1 324 935 discloses a process for forming hollow articles, such as bottles, jars, cases, boxes and similar containers, tubes and like structures, from fibrous material held in suspension. In this reference, a fibrous material or pulp held in suspension in a liquid is deposited on a forming mold and then preliminarily dried before entering into a pressing step where the pulp is formed into a finished article. However, the process of this patent is limited to the production of simple, uncomplicated articles.

U.S. Pat. No. 2 023 200 shows a method for making molded pulp containers having smooth internal and external surfaces and optionally providing ribs either in the inner or outer surfaces of the container. The process of this reference also involves the separation of paper or wood pulp out of a solution and onto a forming mold and the preliminary drying of the pulp to a water content of between 45 to 55 percent by weight before a final compression state. Although the articles produced by the process disclosed in this reference can have crude detailing, such as ribs formed thereon, the provision of more sophisticated detailing, such as threads on the articles, is not possible.

U.S. Pat. No. 2 369 488 discloses a method of manufacturing hollow articles, such as a textile winding core or cone, out of paper pulp which have a core whose outer surface is of sufficient strength to withstand a thread being wound therearound. The paper pulp is mixed with a binder and, optionally, other additives before being deposited on a rotating former to form an embryo cone. The embryo cone is then subjected to a preliminary compacting step to reduce the water content thereof and then to compacting, densifying and shaping operations. Although this reference discloses the manufacture of a hollow article out of paper pulp which is capable of supporting a thread wound on the surface thereof, it is necessary that a binder and, optionally, other additives be added to the paper pulp in order to provide a paper article having the physical properties necessary for the desired purposes.

U.S. Pat. No. 2 986 490 discloses a method for making molded pup articles in which wet molded articles having a moisture content varying from about 10 percent to 75 percent are subjected to a drying and finishing operation between a set of complemental heated pressing dies. However, this method is incapable of producing molded paper products having the improved physical characteristics of the present invention.

U.S. Pat. No. 4 491 502 discloses a method of making a molded paper container, such as a dish or tray, from a paperboard sheet in which a formed sheet is dried to a water content in the range of from about 50 to about 100 percent by weight and then subjected to pressing and drying in a matched metal die set. Although the molded paperboard product of this method is said to have improved strength characteristics, the process of this patent is incapable of producing paper articles having complex configurations.

Therefore, an important object of the present invention is to provide a method capable of producing a molded paper pulp article having an improved surface appearance and superior mechanical and physical properties.

A further object is to provide a relatively simple and inexpensive method for forming a molded paper pulp article having improved surface characteristics, improved mechanical properties and which can be formed into complex structures and recycled.

SUMMARY OF THE INVENTION

The objects and purposes of the invention, including those set forth above, are met according to the invention by providing a method which includes the steps of forming a slurry of paper pulp in water, inserting a foranimous mold into the slurry, pulling a vacuum on the foranimous mold so that a layer of wet paper pulp is deposited thereon, removing the foranimous mold with the deposited layer of wet paper pulp from the slurry, separating the deposited layer of wet paper pulp from the foranimous mold and compressing the layer of wet paper pulp having a solids content of from 5 to 20 percent by weight in such a manner that the wet paper pulp is shaped in the form of the molded paper article and the water content thereof is reduced.

The objects and purposes of this invention are also met by providing a process for manufacturing a molded paper article which includes the steps of preparing a slurry of paper pulp in water, inserting a foranimous mold into the slurry, pulling a vacuum on the foranimous mold so that a layer of wet paper pulp is deposited thereon, removing the foranimous mold with the deposit layer of wet paper pulp from the slurry, optionally conducting a premolding step, optionally conducting a predrying step, separating the deposited layer of wet paper pulp from the foranimous mold, compressing the layer of wet paper pulp having a solids content of from 5 to 20 weight percent in such a manner that the wet paper pulp is shaped into the form of the molded paper article and the water content thereof is reduced and drying the wet paper pulp article to form the product molded paper article.

The objects and purposes of the invention are also met by providing a molded paper article having improved surface appearance characteristics, superior mechanical and physical properties and which can be provided in a complex form.

BRIEF DESCRIPTION OF THE DRAWINGS

An embodiment of the inventive method and article will be described in detail hereinafter with reference to the accompanying drawings, in which.

DETAILED DESCRIPTION

Figure 1:
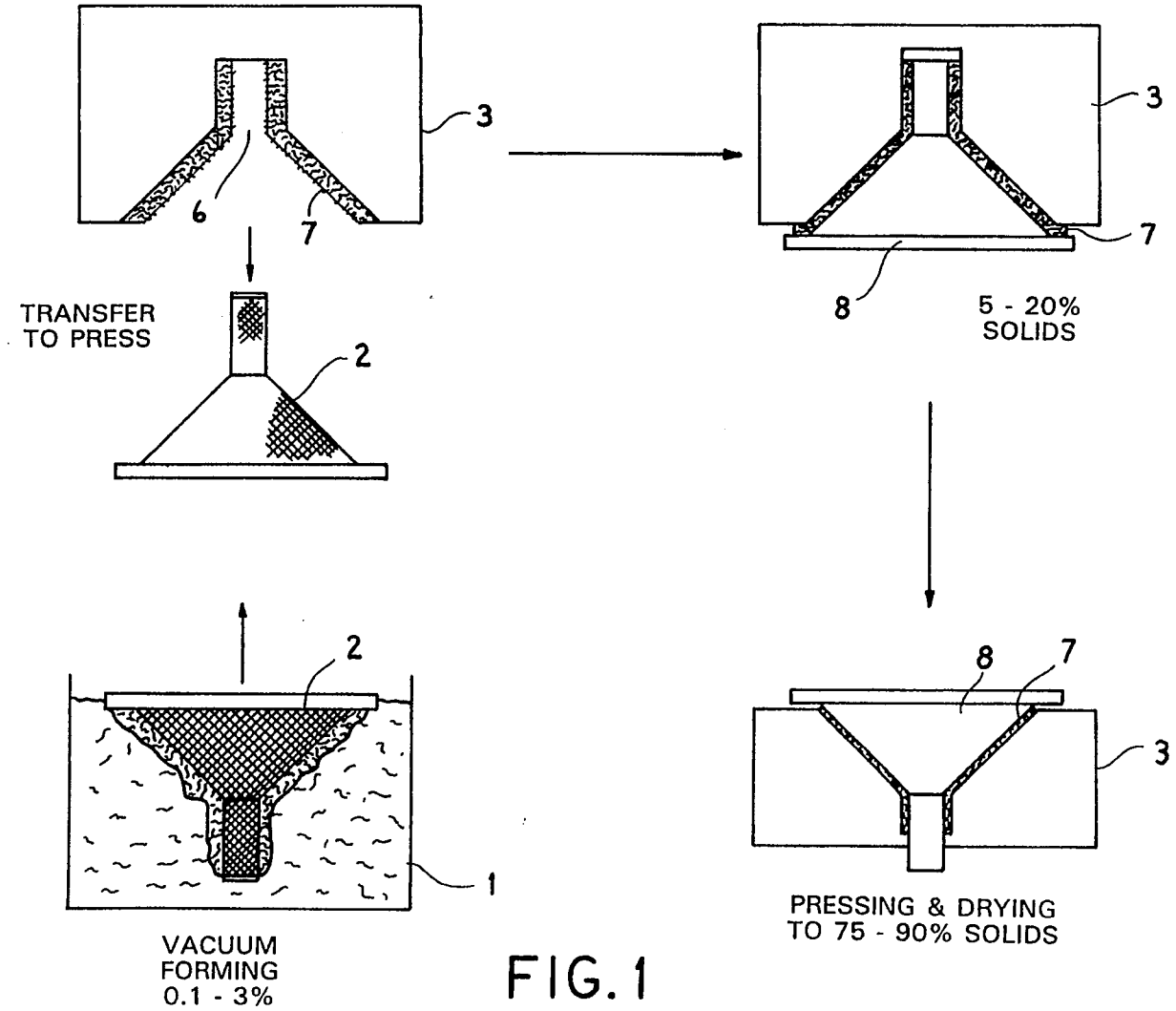
FIG. 1 is a diagram illustrating the process steps of a first embodiment of the present invention.

Referring to FIG. 1, the process of the present invention begins with the formation of a slurry 1 made up of paper pulp and water. The source of the paper pulp is not particularly limited and may be blank newsprint, inked or de-inked newsprint, unbleached soft wood kraft or any other commercially available type of paper stock, including paper mill sludge or any combination of fiber sources. The solids content in the slurry 1 is typically in the range of from 0.1 percent to about 3 percent by weight solids. A solids content of 0.6 percent by weight is particularly preferred in the present invention. The temperature of the slurry is not critical and it is preferably provided at ambient temperatures. However, it must be kept in mind that the colder the temperature of the slurry, the more difficult it will be to deposit the pulp on the forming mold 2 in the subsequent step because of the increased viscosity of the slurry 1.

A forming mold 2 is then inserted into the slurry 1 and a vacuum applied to the forming mold. The forming mold 2 is of the same general configuration as the finished product molded paper pulp article and foranimous in order that the paper pulp will deposit upon the surface thereof from the slurry 1 due to the application of the vacuum. The amount of vacuum to be used to cause the deposition of the paper pulp onto the forming mold 2 will depend on process considerations such as the temperature of the water in the slurry 1, the type of paper pulp provided in the slurry 1 and the product article being produced and is readily determined by one of ordinary skill in the art. At a slurry content of about 0.6 percent by weight solids and a temperature of 85° F., a vacuum applied to the forming mold 2 of 21 inches mercury has been found to be satisfactory. During production, it is best that a slurry 1 of a fixed consistency is used so that the amount of pulp deposited on the forming mold 2 can be readily determined according to the volume of liquid separated from the slurry 1.

Figure 7:
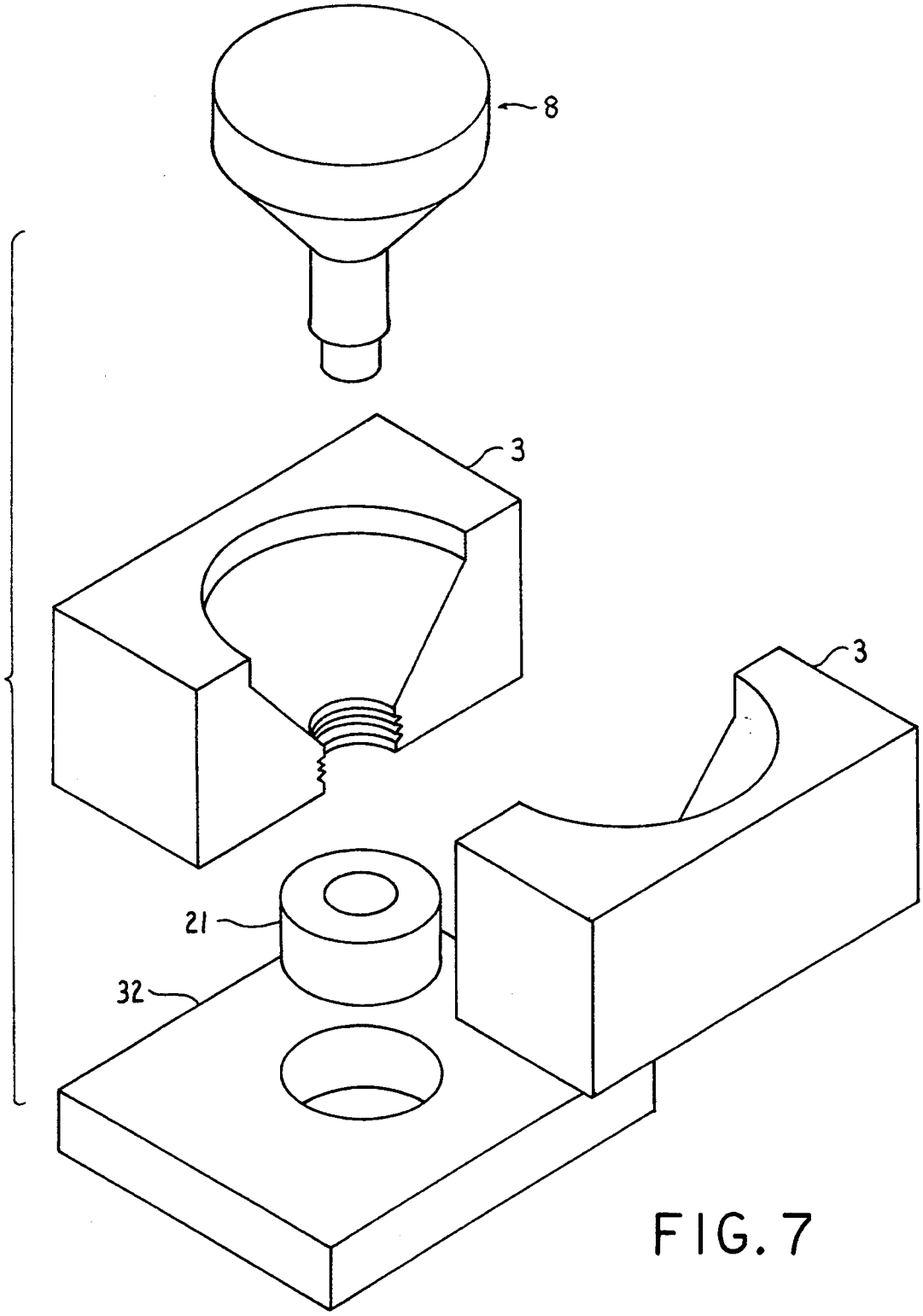
FIG. 7 is an exploded view showing the interengagement between a split female pressing die, the male pressing member and a retaining ring.

After a layer of wet paper pulp 7 has built upon the forming mold 2 at the desired thickness, the forming mold 2 is removed from the slurry 1 and transferred to a female pressing die 3 having a cavity 6 formed therein. The cavity 6 is also provided in a similar configuration of the finished product molded paper article to be produced. The forming mold 2 is lowered into the cavity 6 and the layer of wet paper pulp 7 transferred to the walls of the cavity 6 from the forming mold 2 by the application of a positive air pressure to the forming mold 2. At this stage of the presently claimed process, the layer of wet paper pulp contains from about 5 to about 20 percent by weight solids. In order to aid in the removal of the finished product molded paper article from the female pressing die cavity 6, the female pressing die can be made of separable halves, as illustrated in FIG. 7, in order to facilitate the release of items with negative release angles, sharp curves or abrupt changes in surface orientation. The separable halves are joined together during the pressing step and separated from each other to release the finished product molded paper article.

Figure 2:
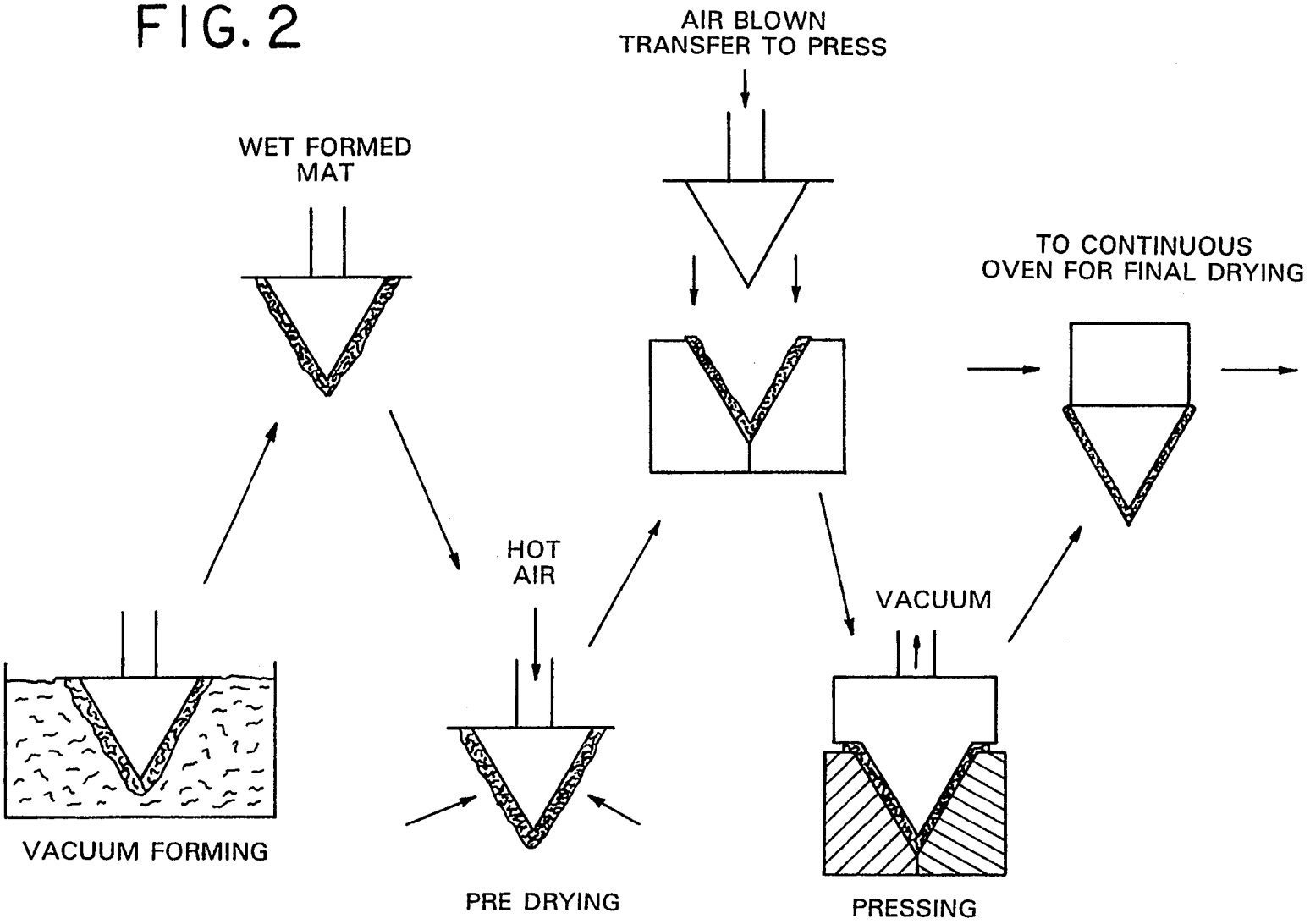
FIG. 2 is a diagram illustrating the process steps of a second process according to the present invention.

As shown in FIG. 2, optionally, a premolding step can be performed before the layer of wet paper pulp 7 is delivered to the female pressing die cavity 6. In the premolding step, the vacuum that is applied to the forming mold 2 during the deposition of the layer of wet paper pulp 7 on the forming mold 2 from the slurry 1 is continued after the forming mold 2 is removed from the slurry 1. This continuous application of vacuum can increase the solids content of the layer of wet paper pulp from about 5 to 7 percent solids to about 12 to 15 percent solids. By the continuous application of vacuum to the forming mold, the layer of wet paper pulp 7 is caused to more closely pack to the forming mold 2 and approximate the shape thereof.

As is also illustrated in FIG. 2, in addition to or in place of the premolding step, a predrying step can be performed before the introduction of the layer of wet paper pulp 7 into the female pressing die cavity 6. The predrying step involves the introduction of a warm gas, such as air, into contact with the layer of wet paper pulp 7 while it is still adhered to the forming mold 2. In the present invention, the solids content of the wet paper pulp layer 7 can be raised up to 20 percent by weight solids if desired. The warm gas can be introduced into contact with the internal surfaces of the layer of wet paper pulp 7 either through the connection for supplying the vacuum to the forming mold 2 or directed at the outer surfaces of the layer of wet paper pulp 7 from an external heating source (not shown). After the premolding and/or predrying steps, the layer of wet paper 7 pulp is then transferred to the female pressing die cavity 6 as discussed above.

As shown in FIG. 1, the layer of wet paper pulp 7 is transferred into the cavity 6 in a manner such that the walls thereof are in substantial alignment with the walls of the cavity 6. That is, the layer of wet paper pulp 7 is deposited into the cavity of the female pressing die 6 in such a manner that the layer of wet paper pulp contacts with the walls of the cavity 6 along the length thereof. At this stage of the inventive process, the solids content of the layer of wet paper pulp 7 is approximately from 5 to 20 percent by weight solids, more preferably 10 to 15 percent by weight solids.

After the layer of wet paper pulp 7 has been deposited in place onto the walls of the female die cavity 6, a male pressing member 8 is inserted into the cavity 6 in such a manner that the layer of wet paper pulp is confined and compressed between the walls of the female pressing die cavity 6 and the male pressing member 8. The male pressing member 8 can be operated by any conventional source, such as pneumatic or hydraulic pressure, and is extendible into and retractable from the female pressing die cavity 6. The male pressing member 8 is provided in the form of the finished product molded paper article and by application of pressure to the layer of wet paper pulp 7 from the male pressing die 8, the layer of wet paper pulp 7 is molded into the shape of the product molded paper article while being constrained in the female pressing die cavity 6. Due to the low solids content of the layer of wet paper pulp 7, the layer 7 readily conforms to the shape of the die cavity 6 and the pressing member 8.

During this pressing step, the solids content of the layer of wet paper pulp 7 can be increased up to 55 percent by weight solids. In order to aid in the removal of water from the layer of wet paper pulp 7, the male pressing member 8 and the female pressing die 6 may be perforated and connected with a source of vacuum in order to more easily transport the water away from the layer of wet paper pulp 7.

It has also been discovered that the placing of a wire screen between the surface of the wet paper pulp layer 7 and the surface of the male pressing member 8 and/or the female pressing die 6 can, in some applications, greatly increase the rate of water removal from the wet paper pulp layer 7. Although this phenomena is not completely understood, it is believed that the wire screen maintains the fibers of the wet paper pulp layer 7 in order and prevents them from blocking the drainage paths in the wet paper pulp layer 7. The mesh size and the overall size of the wire mesh is not critical and can be readily determined depending on the process conditions.

After the layer of wet paper pulp 7 has been molded into the desired configuration, it can then be sent to an oven for final drying. The layer of wet paper pulp 7 is preferably dried while still being confined between the female pressing die cavity 6 and the male pressing member 8 in order to avoid warpage in the molded paper article. In a preferred embodiment of the present invention, the female pressing die 3 and the male pressing member 8 are heated and the layer of wet paper pulp 7 is pressed, dried and vacuumed simultaneously. When the pressing and drying steps are conducted simultaneously, the final solids content of the molded paper article is raised to about 75 to 90 percent by weight solids.

Figure 6:
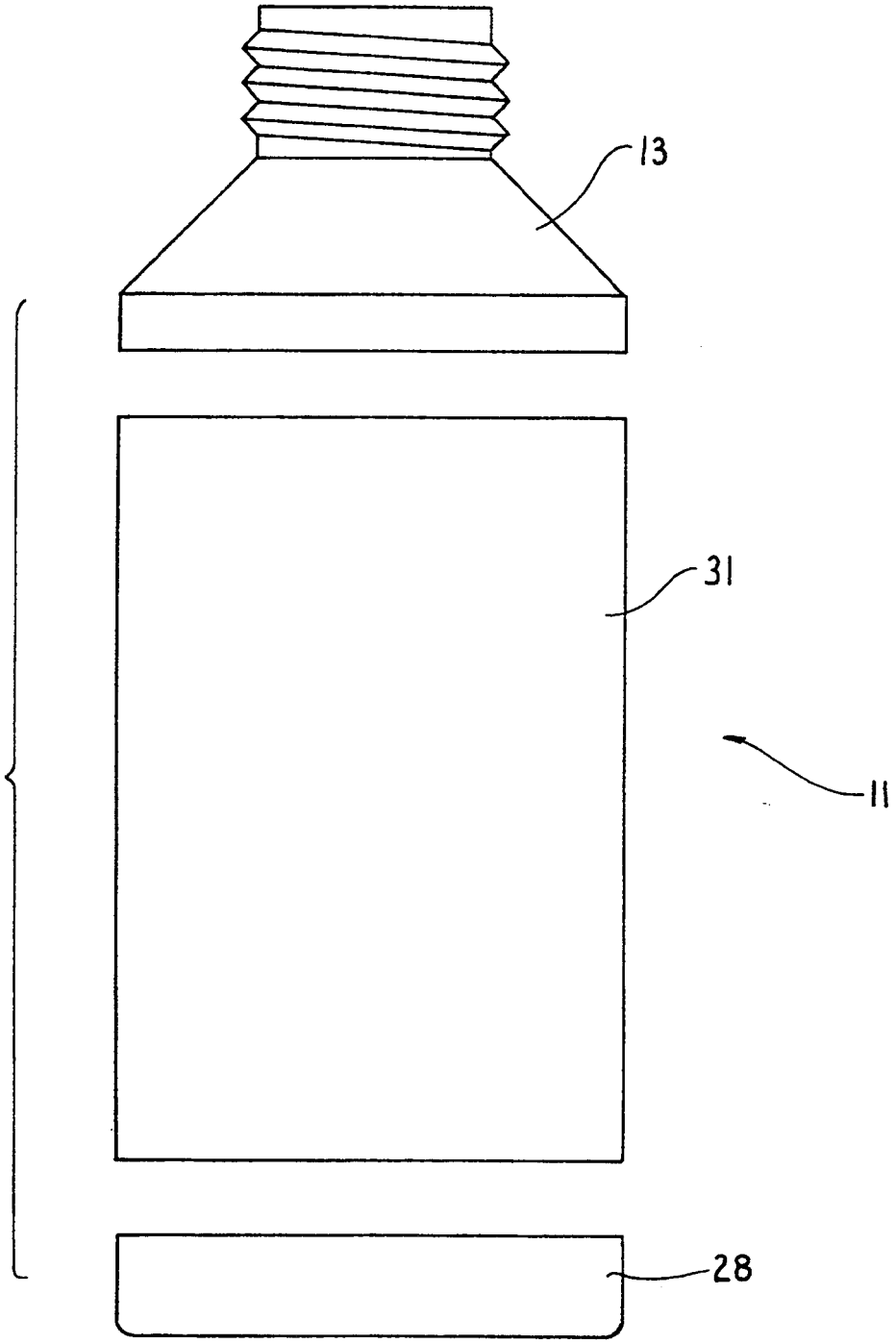
FIG. 6 is an exploded view of a molded paper article of the present invention.

As discussed above, the process of the present invention can be used to prepare molded paper articles having a surface appearance and detailing far superior to those articles produced by conventional processes. As illustrated in FIG. 6, the process of the presently claimed invention is capable of producing a paper container 11 of sufficient strength and detailing that a thread 12 can be provided on an upper portion 13 that is distinct and strong enough for a threaded cap (not shown) to be removably secured thereto.

Figure 4:
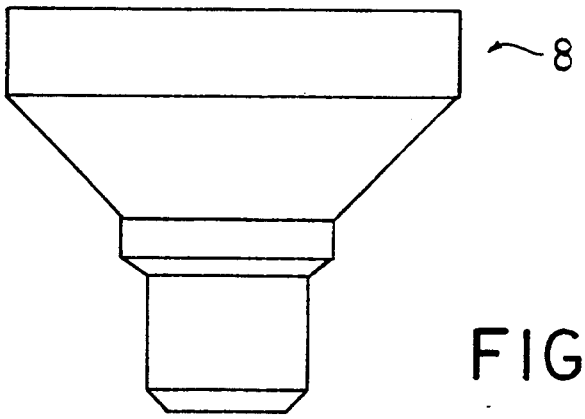
FIG. 4 is an illustration of a male pressing member which can be used in the present invention.
Figure 3:
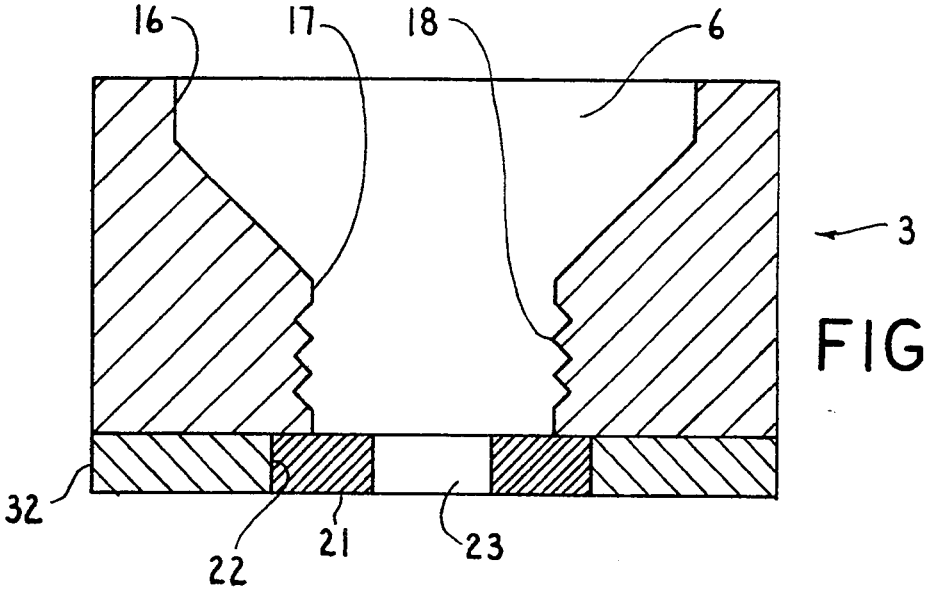
FIG. 3 is a sectional view of a female pressing die which can be used in the present invention.
Figure 5:
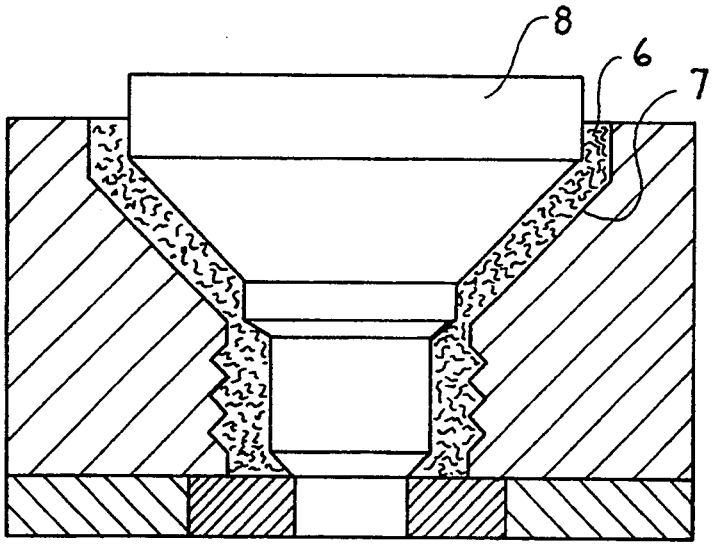
FIG. 5 is a partial sectional view showing the compression of pulp between the male pressing member and female pressing die shown in FIGS. 3 and 4.

For the preparation of the threaded container upper portion 13, the female pressing die 3 is provided in the form illustrated in FIG. 4. The female pressing die cavity 6 is provided in two portions; a frustum-shaped upper portion 16 and a cylindrically shaped lower portion 17. Grooves 18 are provided in the walls of the female pressing die cavity cylindrically shaped lower portion 17 and are used to provide the threads 12 in the container upper portion 13. In the female pressing die 3 illustrated in FIG. 4, a retaining ring 21 is provided in a slot 22 formed in a lower support member 32 thereof. A central opening 23 is provided in the retaining ring 21 and, as illustrated in FIG. 5, functions to center the male pressing member 8 in the female pressing die cavity 6 during the compression of the layer of wet paper pulp 7. In place of the retaining ring 21, an opening can be provided at the bottom of the female pressing die 3 to center the male pressing member 8.

The male pressing member 8 used in producing the threaded container upper portion 13 is illustrated in FIG. 4. This male pressing member 8 comprises a frustum-shaped upper portion 26 and a cylindrically shaped lower portion 27. Additionally, a bevelled intermediate portion 28 of the male pressing member is provided just above and adjacent to the cylindrical portion 27. With the inclination of the bevelled intermediate portion 28, the layer of wet paper pulp 7 adjacent to the grooves 18 in the female pressing die 3 is pressed more firmly into contact with the grooves 18 during the compression of the layer of wet paper pulp 7 between the male pressing member 8 and the female pressing die 3 as illustrated in FIG. 5. With the low solids content of from 5 to 20 weight percent in the wet paper pulp layer 7, the layer 7 is fluid enough to assume the exact dimensions and shape of the grooves 18 and thereby provide a molded paper article having clearly defined threads.

After the compressing and drying stages, the threaded container upper portion 13 is provided. The container bottom 28 can be produced in a similar fashion using suitable male and female pressing die members and the container body 31 formed by rolling a sheet of paper into a cylinder of the desired shape. The container upper portion 13, the container body 31 and the container bottom 28 are then adhered to each other by a suitable adhesive to produce the threaded paper container 11.

As discussed above, the present invention can be used to provide molded paper articles of any desired configuration. That is, many articles made of plastic that are currently vacuum-formed or injection-molded can be made from paper using the process of the present invention.

The present invention will be further illustrated by the following examples and comparative examples.

EXAMPLE 1

A fiber slurry was prepared made up of 0.6 percent by weight solids. The solids consisted of 25 percent by weight unbleached soft wood kraft and 75 percent by weight newsprint blank. The slurry was agitated in order to assure the uniform distribution of the paper pulp in the water and the slurry temperature was maintained at 85° F. A forming mold was inserted into the slurry and a vacuum of 21 inches mercury was pulled thereon for 1 minute and 45 seconds in order to deposit a layer of wet paper pulp made up of 7 percent by weight solids on the forming mold. The forming mold with the layer of wet paper pulp adhering thereto was then transferred to a female pressing die and the layer of wet paper pulp transferred from the forming mold to the cavity of the female pressing die through the application of a positive pressure to the forming mold. A male pressing member was then inserted into the die cavity and the layer of wet paper pulp, at an initial solids content of 7 percent by weight, was compressed between the die cavity and the male pressing member. The layer of wet paper pulp was pressed to a solids content of 60 percent by weight and then transferred to an oven for final drying. The finished product molded paper article had an unblemished smooth surface and clearly defined threads provided thereon.

EXAMPLE 2

The process of Example 1 was repeated under identical conditions except that a premolding step was performed to increase the solids content of the wet paper pulp layer to 14 percent by weight before the introduction of the wet paper pulp layer into the die cavity. The finished product paper article also had an unblemished smooth surface and clearly defined threads provided thereon.

EXAMPLE 3

The process of Example 2 was repeated except that a predrying step was performed in addition to the premolding step to increase the solids content of the layer of wet paper pulp to 18 percent by weight before its introduction into the die cavity. The finished product paper article had a smooth unblemished surface and clearly defined threads provided thereon.

COMPARATIVE EXAMPLE 1

The process of Example 3 was repeated except that the layer of wet paper pulp was predried to a solids content of 21 percent by weight before its introduction into the die cavity. The finished product paper article had a rough surface with cracks provided therein and the thread detailing was irregular.

COMPARATIVE EXAMPLE 2

The process of Example 3 was repeated except that the layer of wet paper pulp was predried to a solids content of 24 percent by weight before its introduction into the cavity of the female pressing die. The surface appearance of the finished product molded article was very rough with numerous cracks and uneven portions provided therein and the thread detailing was very poor.

Certain articles may be transferred to a male member and pressed by the female member. This is determined by the geometry of the product to be produced.

Although particular preferred embodiments of the present invention have been disclosed in detail for illustrative purposes, it should be recognized that variations or modifications of the disclosed invention, including variation of process steps, lie within the scope of the present invention.

The embodiments of the invention in which an exclusive property or privilege is claimed are defined as follows:

1. A method of preparing a molded paper article comprising the steps of:

preparing a slurry of paper pulp and water;

inserting a foraminous mold into the slurry;

pulling a vacuum on the foraminous mold so that a layer of wet paper pulp is deposited thereon;

removing the foraminous mold with the deposited layer of wet paper pulp from the slurry;

separating the deposited layer of wet paper pulp from the foraminous mold; and compressing the separated layer of wet paper pulp having an initial solids content of 5 to 20 weight percent in such a manner that the wet paper pulp is shaped into the form of the molded paper article and e water content thereof is reduced.

2. The method of claim 1, wherein the initial solids content of said layer of wet paper pulp undergoing compression is from 10 to 15 weight percent.

3. The method of claim 1, wherein the slurry consists essentially of paper pulp and water.

4. The method of claim 1, wherein the separated layer of wet paper pulp is compressed in a cavity of a die having the form of the molded paper article.

5. The method of claim 4, wherein the separated layer of wet paper pulp is compressed between walls of the die cavity and an outer surface of a pressing member inserted into the die cavity.

6. The method of claim 5, wherein the pressing member is perforated.

7. The method of claim 4, wherein the die is separable into two halves.

8. The method of claim 5, wherein the die cavity is made up of a frustum-shaped upper portion and a cylinder-shaped lower portion having grooves provided therein and the pressing member is made up of a frustum-shaped upper portion and a cylinder-shaped lower portion.

9. The method of claim 8, wherein a beveled intermediate portion of the pressing member is provided above and directly adjacent to the pressing member cylinder-shaped lower portion.

10. The method of claim 1, wherein the final solids content of the separated layer of wet paper pulp after undergoing compression is from 75 to 90 weight percent.

11. A method of preparing a molded paper article consisting essentially of the steps of:

preparing a slurry of paper pulp and water;

inserting a foraminous mold into the slurry;

pulling a vacuum on the foraminous mold so that a layer of wet paper pulp is deposited thereon;

removing the foraminous mold with the deposited layer of wet paper pulp from the slurry;

separating the deposited layer of wet paper pulp from the foraminous mold; and compressing the separated layer of wet paper pulp having an initial solids content of 5 to 20 weight percent in such a manner that the wet paper pulp is shaped into the form of the molded paper article and water content thereof is reduced.

* * * * *